US007563078B2

(12) United States Patent
Miura et al.

(10) Patent No.: US 7,563,078 B2
(45) Date of Patent: Jul. 21, 2009

(54) RECIPROCATING COMPRESSOR

(75) Inventors: Haruo Miura, Tokyo (JP); Shigeru Arai, Tokyo (JP); Youichirou Fukai, Tokyo (JP); Yasuo Fukushima, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 876 days.

(21) Appl. No.: 11/041,424

(22) Filed: Jan. 25, 2005

(65) Prior Publication Data

US 2005/0260080 A1 Nov. 24, 2005

(30) Foreign Application Priority Data

May 21, 2004 (JP) ..... 2004-151650

(51) Int. Cl.
*F04B 1/04* (2006.01)
*F04B 27/04* (2006.01)

(52) U.S. Cl. ..... 417/273; 417/266; 417/268

(58) Field of Classification Search ..... 417/244, 417/271, 273, 246, 247, 254, 266, 267, 268
See application file for complete search history.

(56) References Cited

U.S. PATENT DOCUMENTS

| | | | | |
|---|---|---|---|---|
| 2,610,785 | A * | 9/1952 | Carlson | 417/343 |
| 2,673,028 | A * | 3/1954 | Cornelius et al. | 417/265 |
| 4,173,433 | A | 11/1979 | Anderson | |
| 4,756,674 | A | 7/1988 | Miller | |
| 4,957,416 | A * | 9/1990 | Miller et al. | 417/273 |
| 7,393,186 | B2 * | 7/2008 | Gao et al. | 417/246 |
| 2004/0057842 | A1 | 3/2004 | Miura et al. | |

FOREIGN PATENT DOCUMENTS

| | | | |
|---|---|---|---|
| CH | 250 726 | A | 9/1947 |
| EP | 1 403 515 | A2 | 3/2004 |
| GB | 752546 | A | 7/1956 |
| JP | 33-9360 | | 7/1933 |
| JP | 48-61407 | | 11/1946 |
| JP | 60-58885 | U | 4/1985 |
| JP | 62-139986 | A | 6/1987 |
| JP | 07-189885 | | 7/1995 |
| JP | 2000-192879 | | 7/2000 |
| JP | EP1403515 | * | 3/2004 |
| WO | WO 03/102416 | A1 | 12/2003 |

OTHER PUBLICATIONS

European Search Report dated Nov. 7, 2006 (four (4) pages).

* cited by examiner

*Primary Examiner*—Charles G Freay
*Assistant Examiner*—Peter J Bertheaud
(74) *Attorney, Agent, or Firm*—Crowell & Moring LLP

(57) ABSTRACT

A reciprocating compressor includes: a low-pressure stage compression part for compressing low-pressure working gas supplied from a supply source; two high-pressure stage compression parts for compressing the working gas compressed by the low-pressure stage compression part at two stages; and a crank mechanism for driving the low-pressure stage compression part and the high-pressure stage compression parts. The two high-pressure stage compression parts each have a plunger and a cylinder and are arranged on both sides of the crank mechanism in such a way as to extend coaxially opposite to each other. The low-pressure stage compression part has a piston and a cylinder and is located in the middle of the two high-pressure stage compression parts. The crank mechanism, the low-pressure stage compression part, and the two high-pressure stage compression parts are substantially located in the same plane.

2 Claims, 4 Drawing Sheets

RECIPROCATING COMPRESSOR

The present application claims priority from Japanese Application JP2004-151650 filed on May 21, 2004, the content of which is hereby incorporated by reference into this application.

BACKGROUND OF THE INVENTION

1. Field of the Invention

The present invention relates to a reciprocating compressor and is particularly suitable for a reciprocating compressor of small capacity and high pressure ratio that sucks combustible gas or toxic gas as working gas at low pressure and compresses the working gas at multiple stages and discharges the working gas at high pressure (for example, high pressure exceeding 70 MPa).

2. Description of the Related Art

For example, specifications covering the suction pressure and discharge pressure of a hydrogen compressor for a hydrogen supply station are determined by market needs and the supply pressure of a hydrogen supply source. There are cases where the pressure of hydrogen produced by a reforming plant or the like is as low as approximately several MPa to one-tenth of several MPa. On the other hand, there are market needs for requiring that the discharge pressure of a compressor exceeds 70 MPa so as to increase the amount of hydrogen fuel charged into a fuel-cell vehicle. Multiple compression stages more than two stages are required for such a specification of low suction pressure and high discharge pressure.

Among the conventional reciprocating compressors of multiple compression stages is a compressor disclosed in Japanese Patent Laid-Open No. H7 (1995)-189885. This reciprocating compressor is of the type in which three cylinders are fixed to the same crankcase and in which respective pistons reciprocating in these three cylinders are driven by the same crankshaft.

The crankcase of this compressor has the first to third cylinder fixing parts on the top surface and on the left and right sides. The crankshaft is rotatably supported in the crankcase and a connecting rod is coupled to the crank pin of the crankshaft. The first to third cylinder fixing parts are formed at positions shifted respectively by 90° in the rotational direction with respect to the rotational center of the crankshaft. The first to third cylinders are fixed to these cylinder fixing parts. The first to third pistons are slidably fitted in the respective cylinders. The tip of the connecting rod is coupled to the piston pin of each piston. Further, each cylinder has a suction valve and an exhaust valve that are opened or closed by the reciprocating motion of the piston pin. With this, when the crankshaft is rotated by a motor, the connecting rod is swung to reciprocate the piston.

Here, three compression parts, each of which is constructed of the cylinder, the piston, and the connecting rod, are arranged side by side in the axial direction. The second cylinder is used for high pressure and the first and third cylinders function as middle-pressure compressors and the compressed air pressurized to middle pressure by the reciprocating motion of the first and third pistons is compressed to high pressure by the second piston.

Further, among the conventional reciprocating compressors of multiple compression stages is a compressor disclosed in Japanese Patent Laid-Open No. 2000-192879. In this reciprocating compressor, a pair of opposed pistons are coupled to the first yoke and another pair of opposed pistons are coupled to the second yoke arranged in such a way that its direction is shifted by 90° with respect to the first yoke to construct four reciprocating compression parts. An electric motor part rotates a crankshaft to rotate a crank pin around the crankshaft to reciprocate the pair of pistons only in the direction of the first axis and to rotate another pair of pistons only in the direction of the second axis.

Here, the first yoke and the second yoke are arranged side by side in the axial direction. Further, four reciprocating compression parts are arranged at positions shifted respectively by 90° from the first reciprocating compression part and compress the working gas to high pressure in sequence.

In the reciprocating compressor disclosed in Japanese Patent Laid-Open No. H7(1995)-189885, three compression parts are arranged side by side in the axial direction. The constructing of a compressor of sucking air at low pressure and discharging the air at high pressure by use of the reciprocating compressor disclosed in this patent document results in increasing the size of the compressor in the axial direction and hence upsizing the compressor and further generating a large couple of forces in the crankshaft and by extension in its bearings, which raises the possibility of increasing loss and reducing the reliability of constituent parts.

Further, in the reciprocating compressor disclosed in Japanese Patent Laid-Open No. 2000-192879, the first yoke and the second yoke are arranged side by side in the axial direction. The constructing of a compressor of sucking air at low pressure and discharging the air at high pressure by use of the reciprocating compressor disclosed in this patent document results in increasing the size of the compressor in the axial direction and hence upsizing the compressor. Further, four reciprocating compression parts are arranged at positions shifted respectively by 90° from the first reciprocating compression part and compress the working gas to high pressure in sequence and the reciprocating compression part of the highest pressure is opposed to the reciprocating compression part the pressure of which is lower than this compression part by two stages. Hence, the pressure difference between these reciprocating compression parts applies a large load to the crankshaft to cause an increase in loss, which is not desirable.

BRIEF SUMMARY OF THE INVENTION

The object of the invention is to provide a reciprocating compressor that is compact and operates with a high degree of efficiency and is excellent in reliability and realizes high pressure ratio.

In order to achieve the object, a reciprocating compressor of the invention is characterized in: that two high-pressure stage compression parts each have a plunger and a cylinder and are arranged on both sides of a crank mechanism in such a way as to extend coaxially opposite to each other; that a low-pressure stage compression part has a piston and a cylinder and is located in the middle of the two high-pressure stage compression parts in such a way as to extend; and that the crank mechanism, the low-pressure stage compression part, and the two high-pressure stage compression parts are substantially located in the same plane.

According to the first aspect of the invention, there is provided a reciprocating compressor including: a low-pressure stage compression part for compressing low-pressure working gas supplied from a supply source; two high-pressure stage compression parts for compressing the working gas compressed by the low-pressure stage compression part at two stages; and a crank mechanism for driving the low-pressure stage compression part and the high-pressure stage compression parts, characterized in: that the two high-pressure stage compression parts each have a plunger and a cylinder and are arranged on both sides of the crank mechanism in such a way as to extend coaxially opposite to each other; that the low-pressure stage compression part has a piston and a cylinder and is arranged in the middle of the two high-pressure stage compression parts in such a way as to extend; and that the crank mechanism, the low-pressure stage compression part, and the two high-pressure stage compression parts are arranged in such a way that they are substantially located in the same plane.

More preferable specific constructions in the first aspect of the invention are as follows.

(1) The crank mechanism includes: an eccentric shaft part that is provided eccentrically in the main shaft part of the crankshaft; a low-pressure stage cross head that is coupled to the piston via a piston rod; a low-pressure stage connecting rod one end of which is coupled to the eccentric shaft part and the other end of which is coupled to the low-pressure stage cross head; a high-pressure stage cross head that is coupled to the two plungers via respective plunger rods; and a high-pressure stage connecting rod one end of which is coupled to the eccentric shaft part and the other end of which is coupled to the high-pressure stage cross head, and the constituent elements of the crank mechanism, the low-pressure stage compression part, and the two high-pressure stage compression parts are arranged in such a way that they are substantially located in the same plane.

(2) The two high-pressure stage compression parts are extended in the horizontal direction from both sides of a crankcase constructing the outside surface of the crank mechanism and the low-pressure stage compression part is extended upward from the top surface of the crankcase.

(3) In addition to the above (1), the high-pressure stage cross head is formed in the shape of one nearly rectangular frame, and the eccentric shaft part, the low-pressure stage connecting rod, and the high-pressure stage connecting rod are arranged in the frame of the high-pressure stage cross head.

(4) In addition to the above (3), the high-pressure stage cross head is arranged in such a way as to move in the horizontal direction, and the high-pressure stage connecting rod is rotatably coupled to a side frame part on one side of the high-pressure stage cross head, and the two plunger rods are coupled to side frame parts on both sides of the high-pressure stage cross head, respectively.

(5) In addition to the above (3), the high-pressure stage cross head has an opening formed through its top frame part in the vertical direction and the low-pressure connecting rod is passed through the opening and is coupled to the eccentric shaft part and the low-pressure stage cross head.

(6) In addition to the above (5), one end of the high-pressure stage connecting rod is bifurcated and coupled to the eccentric shaft part, and one end of the low-pressure stage connecting rod is arranged in a center space between the bifurcated portions of the high-pressure stage connecting rod and is coupled to the eccentric shaft part.

According to the second aspect of the invention, there is provided a reciprocating compressor of the type including: a low-pressure stage compression part for compressing low-pressure working gas supplied from a supply source; two high-pressure stage compression parts for compressing the working gas compressed by the low-pressure stage compression part at two stages; and a crank mechanism for driving the low-pressure stage compression part and the high-pressure stage compression parts, characterized in: that the two high-pressure stage compression parts each have a plunger and a cylinder and are arranged on both sides of the crank mechanism in such a way as to extend coaxially opposite to each other; that the low-pressure stage compression part has a compression part, which includes one piston and one cylinder constructing compression chambers on both sides of the piston and compresses the working gas at two stages, and is arranged in the middle of the two high-pressure stage compression parts in such a way as to extend; and that the crank mechanism, the low-pressure stage compression part, and the two high-pressure stage compression parts are arranged in such a way that they are substantially located in the same plane.

More preferable specific constructions in the second aspect of the invention are as follows.

(1) The low-pressure stage compression part has the first compression stage compression part, which compresses the low-pressure working gas supplied from the supply source, formed on one side of the piston and has the second compression stage compression part, which compresses the working gas compressed by the first compression stage compression part, formed on the other side of the piston. One of the two high-pressure stage compression parts constructs the third compression stage compression part for compressing the working gas compressed by the second compression stage compression part and the other of the two high-pressure stage compression parts constructs the fourth compression stage compression part for compressing the working gas compressed by the third compression stage compression part.

According to the third aspect of the invention, there is provided a reciprocating compressor including: a low-pressure stage compression part for compressing low-pressure working gas supplied from a supply source; two high-pressure stage compression parts for compressing the working gas compressed by the low-pressure stage compression part at two stages; and a crank mechanism for driving the low-pressure stage compression part and the high-pressure stage compression parts, characterized in: that the two high-pressure stage compression parts each have a plunger and a cylinder and are arranged on both sides of the crank mechanism in such a way as to extend coaxially opposite to each other; that the low-pressure stage compression part has a piston and a cylinder and is arranged in the middle of the two high-pressure stage compression parts in such a way as to extend; that the crank mechanism includes: an eccentric shaft part that is provided eccentrically in the main shaft part of the crankshaft; a low-pressure stage cross head that is coupled to the piston via a piston rod; a low-pressure stage connecting rod one end of which is coupled to the eccentric shaft part and the other end of which is coupled to the low-pressure stage cross head; a high-pressure stage cross head that is coupled to the two plungers via respective plunger rods; and a high-pressure stage connecting rod one end of which is coupled to the eccentric shaft part and the other end of which is coupled to the high-pressure stage cross head, the two plunger rods each having a high-pressure stage rod packing seal on its outer periphery, the high-pressure stage rod packing seal being formed such that it has a high-pressure side rod packing and a low-pressure side rod packing arranged side by side and that an intermediate portion between the high-pressure side rod packing and the low-pressure side rod packing communicates with the suction side of the low-pressure stage compression part; and that the constituent elements of the crank mechanism, the low-pressure stage compression part, and the two high-pressure stage compression parts are arranged in such a way that they are substantially located in the same plane.

More preferable Specific constructions in the third aspect of the invention are as follows.

(1) The piston rod has a low-pressure stage rod packing seal on its outer periphery, the low-pressure stage rod packing seal being formed in such a way that it has a high-pressure side rod packing and a low-pressure side rod packing arranged side by side and that an intermediate portion between the high-pressure side rod packing and the low-pressure side rod packing communicates with the suction side of the low-pressure stage compression part.

(2) The two high-pressure stage compression parts extend in the horizontal direction via cylindrical cases from both sides of a crankcase constructing the outer surface of the crank mechanism part, and the low-pressure stage compression part extends upward via a cylindrical case from the top surface of the crankcase, and the low-pressure stage cross head has a seal ring on its outer periphery, and the plunger rod has a seal ring on its outer periphery.

BRIEF DESCRIPTION OF THE SEVRAL VIEWS OF THE DRAWINGS

FIG. 1 is its external view and

FIG. 2 is a schematic view of its construction and

FIG. 3 is a perspective view of a crank mechanism part.

DETAILED DESCRIPTION OF THE INVENTION

Figure 1:
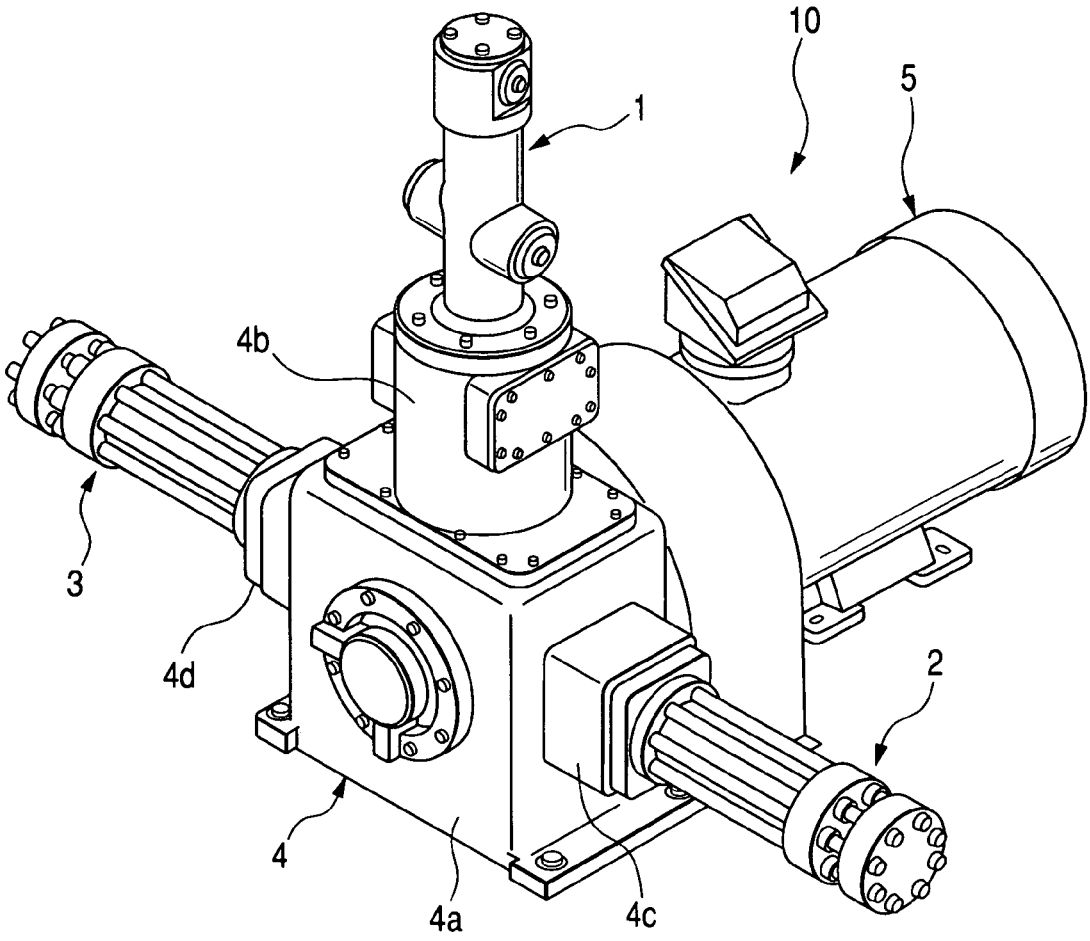
FIGS. 1 to 3 show one embodiment of a reciprocating compressor in accordance with the invention.

A plurality of embodiments of the invention will be described below by use of drawings. The same reference symbols in the drawings of the respective embodiments denote the same parts or corresponding parts. A reciprocating compressor of the first embodiment of the invention will be described by use of FIGS. 1 to 3. First, referring to FIG. 1, the external construction of the reciprocating compressor of the first embodiment will be described. FIG. 1 is an external view to show the reciprocating compressor of the first embodiment.

A reciprocating compressor 10 is provided with and constructed of a low-pressure stage compression part 1, high-pressure stage compression parts 2 and 3, a crank mechanism part 4, and a motor 5. Combustible working gas such as hydrogen gas or toxic working gas can be used and hydrogen gas is used in this embodiment.

Figure 2:
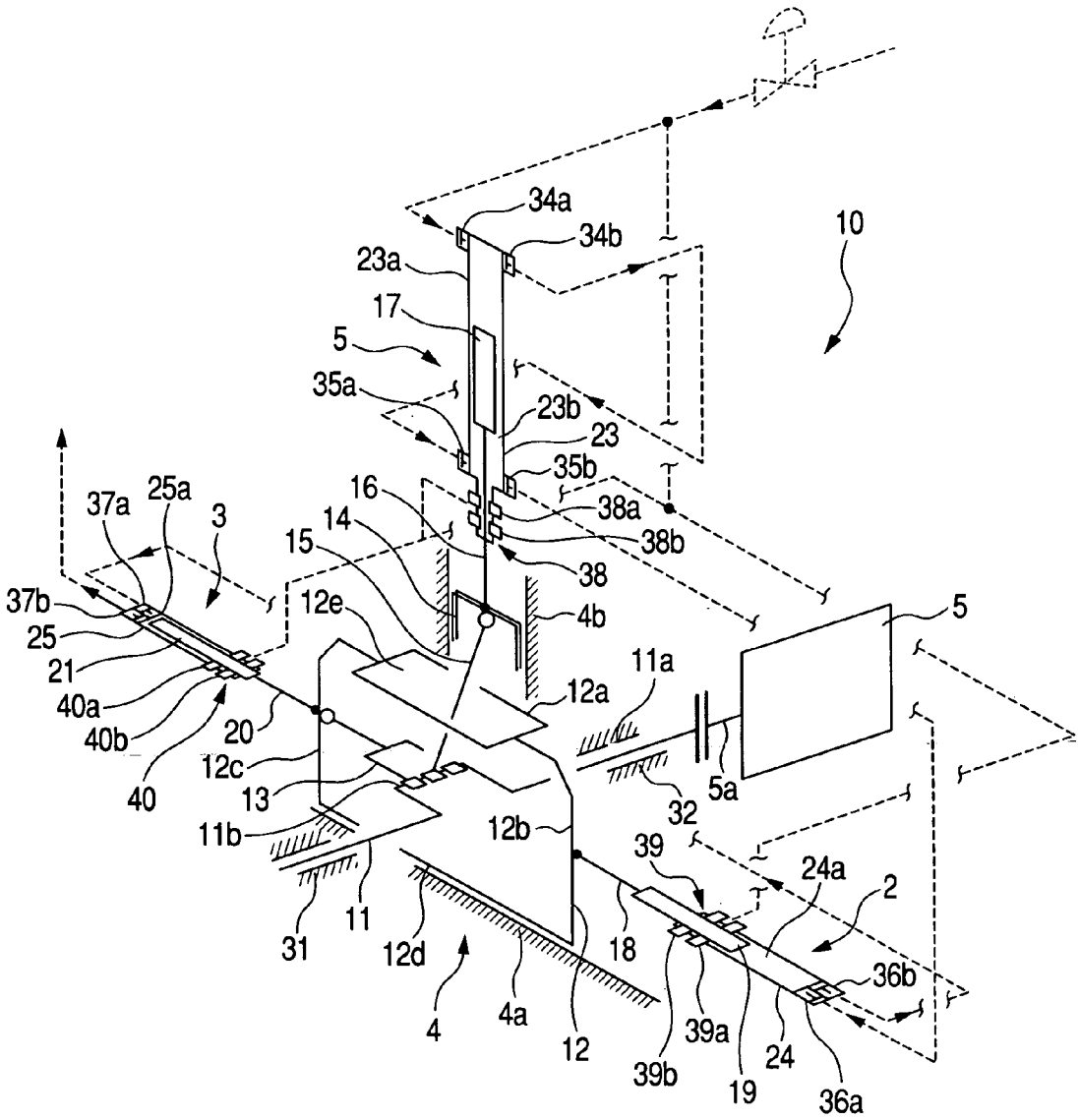

The low-pressure stage compression part 1 compresses low-pressure working gas supplied by a supply source and has the first compression stage compression part 23*a* (see FIG. 2) and the second compression stage compression part 23*b* (see FIG. 2). The high-pressure stage compression part 2 further compresses the working gas compressed by the low-pressure stage compression part 1 and constructs the third compression stage compression part. The high-pressure stage compression part 3 further compresses the working gas compressed by the high-pressure stage compression part 2 and constructs the fourth compression stage compression part.

The crank mechanism part 4 drives the low-pressure stage compression part 1, the high-pressure stage compression part 2, and the high-pressure stage compression part 3 and has a crankcase 4*a*, which forms its outside surface, and cylindrical cases 4*b* to 4*d*. The crankcase 4*a* is basically formed in the shape of a box that is thin in the front-and-rear direction. The cylindrical case 4*b* connects the crankcase 4*a* to the low-pressure stage compression part 1 and the cylindrical case 4*c* connects the crankcase 4*a* to the high-pressure stage compression part 2 and the cylindrical case 4*d* connects the crankcase 4*a* to the high-pressure stage compression part 3. The motor 5 drives the low-pressure stage compression part 1, the high-pressure stage compression part 2, and the high-pressure stage compression part 3.

Further, the crank mechanism part 4 is arranged in the center of the constituent elements of the low-pressure stage compression part 1, the high-pressure stage compression part 2, the high-pressure stage compression part 3, and the motor 5. In other words, the high-pressure stage compression part 2, the low-pressure stage compression part 1, and the high-pressure stage compression part 3 are mounted on three surfaces (top surface and both side surfaces except for bottom surface in this embodiment) continuing in the peripheral direction of the crankcase 4*a* in such a way as to protrude from the surfaces and the motor 5 is mounted on one surface (back surface in this embodiment) constructing the front and back surfaces of the crankcase 4*a* in such a way as to protrude from the one surface. This construction can reduce the size of the reciprocating compressor 10.

Further, in this embodiment, each of the low-pressure stage compression part 1, the high-pressure stage compression part 2, and the high-pressure stage compression part 3 is formed in the shape of a slender cylinder, and is extended radially from each of three surfaces of the crankcase 4*a*. The low-pressure stage compression part 1 is mounted on the top surface of the crankcase 4*a* in such away as to protrude vertically. The high-pressure stage compression part 2 and the high-pressure stage compression part 3 are mounted on both side surfaces of the crankcase 4*a* in a protruding manner in such a way that they are coaxially opposed to each other in the horizontal direction. In other words, the high-pressure stage compression part 2 and the high-pressure stage compression part 3 are arranged coaxially on opposite sides of the crank mechanism part 4. This construction can reduce the load applied to the crankshaft 11 and hence can reduce its bearing loss. Further, the low-pressure stage compression part 1, the high-pressure stage compression part 2, and the high-pressure stage compression part 3 are arranged in a single row in the front-and-back direction (in the axial direction of the crankshaft 11), so that the size of the compressor can be reduced in the axial direction and a couple of forces that are applied to the main bearings 31, 32 by the crankshaft 11 can be reduced, which can reduce bearing loss and can improve the reliability of constituent parts such as main bearings 31, 32.

Figure 3:
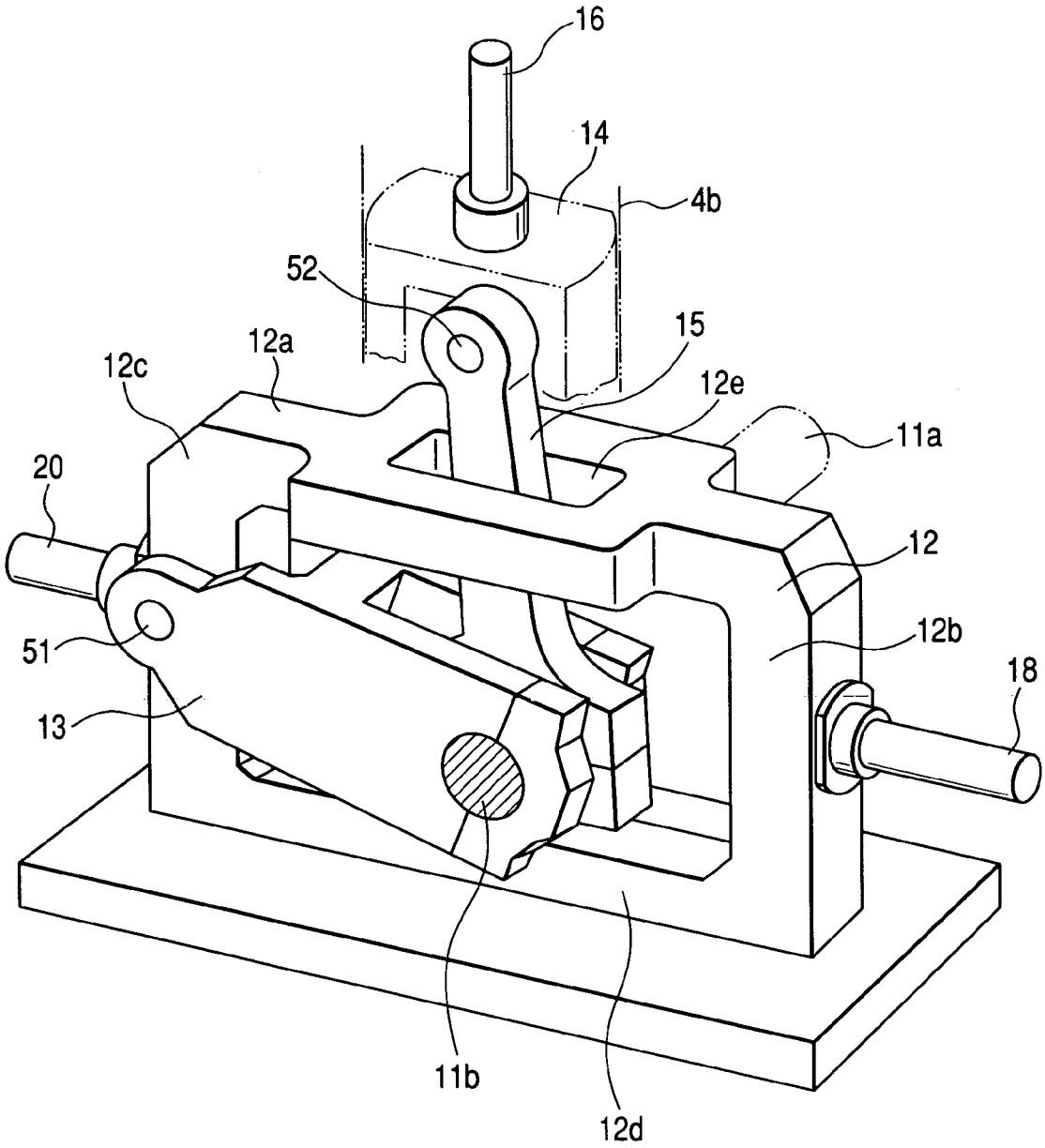

Next, the concrete construction of the reciprocating compressor 10 realizing the above arrangement will be described by reference to FIGS. 2 and 3. FIG. 2 is a schematic view of construction of the reciprocating compressor of this embodiment and FIG. 3 is a perspective view of the crank mechanism part of the reciprocating compressor.

The crankshaft 11 is coupled to the rotary shaft 5*a* of the motor 5 of a driving source and is rotated by the motor 5. This crankshaft 11 is arranged in such a way as to extend back and forth and has a main shaft part 11*a* and an eccentric shaft part 11*b*. One end of the main shaft part 11*a* is coupled to the rotary shaft 5*a* of the motor 5. The eccentric shaft part 11*b* is provided at the other end of the main shaft part 11*a* and has an eccentric axis with respect to the axis of the main shaft part 11*a*. The main bearings 31, 32 support the main shaft part 11*a* located on both sides of the eccentric shaft part 11*b*. With this construction, force applied to the eccentric shaft part 11*b* is transmitted from the eccentric shaft part 11*b* to the main shaft part 11*a*, thereby being received by the main bearings 31, 32. It is preferable that the space between these main bearings 31, 32 is as small as possible. According to the construction of this embodiment, the low-pressure stage compression part 1, the high-pressure stage compression part 2, and the high-pressure stage compression part 3 are arranged in a single row in the axial direction of the crankshaft 11 to reduce the space between the main bearings 31, 32, which can improve the reliability of the reciprocating compressor 10.

One ends of the connecting rods 13, 15 are rotatably coupled adjacently to each other to the same eccentric shaft part 11*b*. The one end of the connecting rod 13 is formed into bifurcated portions and the one end of the connecting rod 15 is located in the center space between the bifurcated portions. The other end of the connecting rod 13 is extended in the lateral direction and is rotatably coupled to a cross head 12 shaped like a rectangular frame via a coupling pin 51. The other end of the connecting rod 15 is extended upward and is rotatably coupled to a cross head 14 via a coupling pin 52. This construction reduces the size of the reciprocating compressor 10 in the front-and-back direction.

Further, the eccentric shaft part 11*b* and the cross head 12 are coupled to each other via the connecting rod 13 to convert the eccentric rotational motion of the eccentric shaft part 11*b* to the left-and-right reciprocating motion of the cross head 12. Further, the eccentric shaft part 11*b* and the cross head 14 are coupled to each other via the connecting rod 15 to convert the eccentric rotational motion of the eccentric shaft part 11*b* to the up-and-down reciprocating motion of the cross head 14.

The eccentric shaft part 11*b*, the connecting rods 13 and 15, the cross head 12 are stored in one crankcase 4*a*. The cross head 14 is stored in the cylindrical case 4*b* provided on the top surface of the crankcase 4*a*. This cylindrical case 4*b* connects the crankcase 4*a* to the low-pressure stage compression part 1.

The cross head 12 is placed on the bottom surface of the crankcase 4*a* having no compression part in such a way as to slide in the left-and-right direction by utilizing the bottom surface of the crankcase 4*a*. The lower frame part 12*d* of the cross head 12 can slide smoothly on the crankcase 4*a* by interposing a shoe (not shown) between the frame part 12*d* and the crankcase 4*a*. Further, the eccentric shaft part 11*b* and the connecting rods 13, 15 are arranged in the frame of the cross head 12. This construction can also reduce the size of the reciprocating compressor 10.

An opening 12*e* is formed in the center of an upper frame part 12*a* of the cross head 12 and the connecting rod 15 is extended vertically through this opening 12*e*. The opening 12*e* is formed in such a way as to be nearly identical to the space between the bifurcated portions of the connecting rod 13 in the front-and back direction. This construction makes it possible to secure the strength of the cross head 12 as a frame body and to arrange the low-pressure stage compression part 1, the high-pressure stage compression part 2, and the high-pressure stage compression part 3 in a single row (in the same plane). The opening of the upper frame part 12*a* of the cross head 12 may be formed by fixing other members to each other with bolts.

One end of the low-pressure stage piston rod 16 is coupled to the cross head 14 and the low-pressure stage piston rod 17 is coupled to the other end of the piston rod 16. The piston 17 is slidably stored in the low-pressure stage cylinder 23. By the piston 17 and the cylinder 23, the first compression stage compression part 23*a* and the second compression stage compression part 23*b* are formed on both sides of the piston 17.

One end of a plunger rod 18 for the third compression stage is coupled to the side frame part 12*b* of one side (right side) of the cross head 12. A plunger 19 for the third compression stage is coupled to the other end of the plunger rod 18. This plunger 19 forms the third compression stage compression part 24*a* with a cylinder 24 for the third compression stage.

Further, one end of a plunger rod 20 for the fourth compression stage is coupled to the side frame part 12*c* of the other side (left side) of the cross head 12. A plunger 21 for the fourth compression stage is coupled to the other end of the plunger rod 20. This plunger 21 forms the fourth compression stage compression part 25*a* with a cylinder 25 for the fourth compression stage.

According to this construction, the piston rod 16 for forming the low-pressure stage compression part 1 and the plunger rods 18, 20 for forming the high-pressure two-stage compression parts 2, 3 can be reciprocated in the same plane by the rotational motion of the one eccentric shaft part 11*b*.

When the crankshaft 11 is rotated by the motor 5, the rotational motion of the crankshaft 11 is converted to the swing motion of the connecting rod 15 and then to the reciprocating motion of the cross head 14, thereby reciprocating the piston 17. Further, the rotational motion of the crankshaft 11 is converted to the swing motion of the connecting rod 13 and then the reciprocating motion of the cross head 12, thereby reciprocating the plungers 19, 21.

When the piston 17 is reciprocated, the working gas is sucked into the first compression stage compression part 23*a* of the cylinder 23 through a valve 34*a* and is compressed there and is discharged through a discharge valve 34*b*. In this embodiment, the working gas is compressed from a low supply pressure of several MPa or less to a pressure of approximately 5 MPa and is discharged. In FIG. 2, the system shown by dotted lines shows a system in which the working gas flows and arrows show the direction of flow.

The working gas is sucked through a suction valve 35*a* into the second compression stage compression part 23*b* of the cylinder 23 and is compressed there and is discharged through a discharge valve 35*b*. In this embodiment, the working gas is compressed from a pressure of approximately 5 MPa to a pressure of approximately 14 MPa and is discharged. Then, the working gas is sucked through a suction valve 36*a* into the third compression stage compression part 24*a* of the cylinder 24 and is compressed there and is discharged through a discharge valve 36*b*. In this embodiment, the working gas is compressed from a pressure of approximately 14 MPa to a pressure of approximately 36 MPa and is discharged. Then, the working gas is sucked through a suction valve 37*a* into the four the compression stage compression part 25*a* of the cylinder 25 and is compressed there and is discharged through a discharge valve 37*b*. In this embodiment, the working gas is compressed from a pressure of approximately 36 MPa to a pressure of approximately 84 MPa and is discharged. Here, the pressure ratio shown in this embodiment is one example.

In this manner, the crank part of the crankshaft 11 constructs a four-stage compression part by one structure (that is, a single-row crankcase 4*a*) and can compress the working gas at a high pressure ratio. Further, since the low-pressure stage axis and the high-pressure two-stage axis are arranged in the same plane in this embodiment, couple of forces are not applied to the main bearings 31, 32, which can improve also the reliability of the main bearings 31, 32.

Further, since the high-pressure two-stage compression parts 2, 3 are opposed coaxially to each other via the cross head 12, the load applied to the crankshaft 11 and, by extension, the load applied to the main bearings 31, 32 for supporting the crankshaft 11 can be reduced, which results in reducing loss.

By making the low-pressure stage compression part arranged vertically be of the reciprocating type, it is possible to make the inertial force of the piston 17 and the like cancel out the thrust force of the working gas produced by the pressure of the working gas, which results in reducing the load applied to the crankshaft 11 and, by extension, reducing the load applied to the main bearings 31, 32, and reducing loss. In this manner, the load applied to the crankshaft 11 and the main bearings 31, 32 can be reduced, so that the lives of these parts can be elongated. Although not shown in this embodiment, it is more suitable that the plunger rods 18, 20, each of which is interposed between each of the high-pressure stage plungers 19, 20 and the cross head 12, be of structure having a guide.

On the other hand, a low-pressure stage rod packing seal 38 and high-pressure two-stage rod packing seals 39, 40 are divided into high-pressure side packing 38*a*, 39*a*, and 40*a* constructing a group of high-pressure side packing and low-pressure packing 38*b*, 39*b*, and 40*b* constructing a group of low-pressure side packing, respectively. Chambers located between the high-pressure side packing 38*a*, 39*a*, and 40*a* and the low-pressure side packing 38*b*, 39*b*, and 40*b* are made to communicate with the suction line of the first compression stage compression part 23*a*. With this construction, the sealing pressure difference between the respective rod packing seals 38 to 40 and the atmospheric pressure is made equal to the pressure difference between the respective rod packing seals 38 to 40 and the suction pressure of the first compression stage compression part 23*a* and atmospheric pressure and hence can be minimized in the system. That is, the amount of leakage of the working gas to the atmosphere can be minimized, that is, the amount of leakage to the outside can be minimized, which results in enhancing the safety of the compressor.

Figure 4:
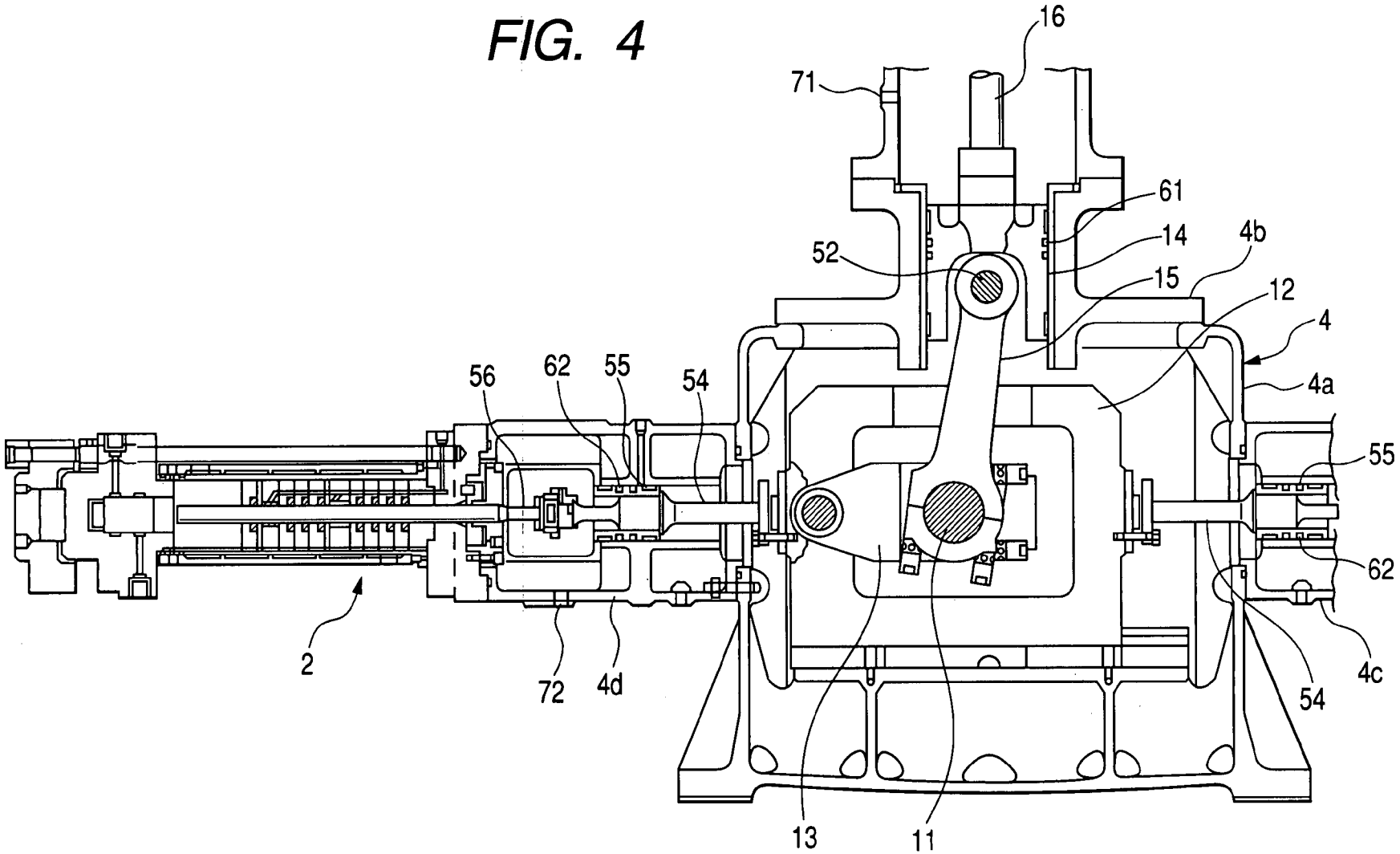
FIG. 4 is a sectional view of the main portion of another embodiment of a reciprocating compressor in accordance with the invention.

Next, the second embodiment of the invention will be described by use of FIG. 4. FIG. 4 is a cross-sectional view of the main portion of a reciprocating compressor of the second embodiment of the invention. Here, in the description of the second embodiment, the overlapping descriptions of the parts common to the first embodiment will be omitted. In this second embodiment, a seal ring 61 is provided on the outer peripheral portion of the cross head 14 arranged in the vertical direction and is slidably moved on the inner surface of the cylindrical case 4*b* to secure the hermeticity between the cross head 14 and the cylindrical case 4*b*. A gas discharging hole 71 is formed in a portion of the cylindrical case 4*b*, which is closer to the low-pressure stage compression part 1 than the seal ring 61.

Intermediate guide rods 54 are provided on both sides of the cross head 12 arranged in the horizontal direction. A seal ring 62 is provided on the outer peripheral portion of a piston part 55 of each of the intermediate guide rods 54 and is slidably moved on the inner surface of the cylindrical case 4*c* (or 4*d*) to secure the hermeticity between the intermediate guide rod 54 and the cylindrical case 4*c* (or 4*d*). A gas discharging hole is formed at a portion of the cylindrical case 4*c*, which is closer to the high-pressure stage compression part 2 than the seal ring 62 and another gas discharging hole 72 is formed at a portion of the cylindrical case 4*d*, which is closer to the high-pressure stage compression part 3 than the seal ring 62. Although only a portion of one of the high-pressure stage compression parts (high-pressure stage compression part 3) is shown in FIG. 4, the high-pressure stage compression part 2 has the same structure as the high-pressure stage compression part 3.

With this construction, the working gas leaking to the atmosphere from the low-pressure stage rod packing seal 38 can be safely introduced into flare without being leaked into the crankcase 4*a* from the gas discharging hole 71. Further, the working gas leaking from the high-pressure stage compression part rod packing seals 39, 40 can be also introduced similarly into the flare without being leaked into the crankcase 4*a* from the gas discharging holes 72. This can improve safety.

The above-described embodiments can be summarized as follows from the viewpoint of functions.

(1) To reduce the size of a compressor of small capacity and high pressure ratio and to optimize the structure of the compressor in consideration of cost efficiency First, the third and fourth high-pressure compression stage compression parts 24*a*, 25*a*, to which the working gas applies extremely large thrust force, are arranged opposite to each other in the horizontal direction. Since these high-pressure two-compression stage compression parts 24*a*, 25*a* are reduced in displacement flow rate, a plunger type compression structure is used for them. The first and second low-pressure two-compression stage compression parts 23*a*, 23*b* are arranged in the vertical direction. Since these low-pressure two-compression stage compression parts 23*a*, 23*b* are comparatively large in displacement flow rate, they are of the construction in which a piston type reciprocating compression stage is used to perform two-stage compression by one piston.

Further, by adopting the following structure, the compressor can be made compact and the load applied to the crankshaft 11 and its bearings can be reduced, which results in reducing loss and reducing the size of structure.

The cross head 12 that can move in the horizontal direction and has the opening 12*e* in its top is arranged in one crankcase 4*a* and the crankshaft 11 having the eccentric shaft part 11*b* passing thought this cross head 12 is arranged. In the connecting rod 13 for coupling the cross head 12 to the crankshaft 11, the portion coupled to the crankshaft 11 is bifurcated to form a space in the center portion. The connecting rod 15 for coupling the crankshaft 11 to the compression stage cross head 14 arranged in the vertical direction is arranged in this space. Here, the above-described opening 12*e* is formed in the top of the cross head 12, as described above, and the low-pressure stage connecting rod 15 is arranged through this opening 12*e*. One end of this connecting rod 15 is coupled to the eccentric shaft part 11*b* of the crankshaft 11 and the other end is coupled to the low-pressure stage cross head 14. Further, the piston rod 16 is coupled to the cross head 14 and has the piston part forming the first and second compression stage at its tip portion.

By constructing four compression stages in this manner, all compression stages can be arranged within one axis only by one crankcase 4*a*. That is, since four compression stages can be arranged in one row, it is possible to reduce a size required in the direction of the crankshaft and hence to achieve the downsizing of the compressor. Further, since the high-pressure two-stage compression parts are opposed to each other via the cross head 12, it is possible to reduce the load applied to the crankshaft 11 and, by extension, the load applied to the main bearings 31, 32 for supporting the crankshaft 11 and hence to reduce loss. By making the low-pressure stage compression part 1 arranged vertically be of the reciprocating type, it is possible to make the inertia force of the piston and the like cancel out the thrust force of the working gas caused by the pressure of the working gas, which results in reducing the load applied to the crankshaft 11 and, by extension, the load applied to the main bearings 31, 32 and reducing loss. Further, as described above, these forces are substantially in the same plane and hence do not apply couple of forces to the crankshaft 11. That is, since neither excessive load nor local load is applied to the main bearings 31, 32, the reliability of the main bearings 31, 32 can be enhanced.

(2) To minimize the amount of leakage of combustible and explosive working gas and to discharge leaking working gas The high-pressure two-stage compression rod packing seals 39, 40 are divided into high-pressure side rod packing 39*a*, 40*a* and low-pressure side rod pacing 39*b*, 40*b* and their intermediate portions are made to communicate with the first stage suction line, respectively, whereby the sealing pressure difference in the working gas between the rod packing seals 39, 40 and the atmosphere can be reduced. Further, the rod packing seal 38 provided at the portion through which the low-pressure stage piston rod is passed is also divided similarly and its intermediate chamber is made to communicate with the first stage suction line, whereby the sealing pressure difference in the working gas between the rod packing seal 38 and the atmosphere can be reduced. With this construction, the amount of working gas leaking from the rod packing seals 38 to 40 to the crank case 4*a* can be minimized. Here, the leaking working gas is discharged to the atmosphere through a purge line.

(3) To enhance reliability

If the high-pressure stage compression parts 3, 4 are arranged in the manner described above, the load applied to the crankshaft 11 and the main bearings 31, 32, and the like can be reduced, so that the lives of the parts can be elongated and the amount of leakage to the outside can be reduced. Further, the seal ring 61 is provided on the outer peripheral portion of the cross head 14 arranged in the vertical direction and the intermediate guides 54 each having the seal ring 62 on its outer peripheral portion are provided on both sides of the cross head 12 arranged in the horizontal direction. With this construction, the working gas leaking from the low-pressure stage rod packing seal 61 to the atmosphere can be introduced to flare without leaking to the crank case 4*a*. Further, the working gas leaking from the rod packing seal 62 of the high-pressure compression stage can be also introduced similarly to the flare without leaking to the crank case 4*a*.

According to the invention, it is possible to produce a reciprocating compressor of high pressure ratio that is reduced in size and has high efficiency and is excellent in reliability.

What is claimed is:

1. A reciprocating compressor, comprising:

a low-pressure stage compression part for compressing low-pressure working gas supplied from a supply source;

two high-pressure stage compression parts for compressing the working gas compressed by the low-pressure stage compression part at two stages; and a crank mechanism for driving the low-pressure stage compression part and the high-pressure stage compression parts, wherein the two high-pressure stage compression parts each have a plunger and a cylinder and are arranged on both sides of the crank mechanism in such a way as to extend coaxially opposite to each other, wherein the low-pressure stage compression part has a piston and a cylinder and is arranged in the middle of the two high-pressure stage compression parts in such a way as to extend, wherein the crank mechanism includes:

an eccentric shaft part that is provided eccentrically in a main shaft part of the crankshaft;

a low-pressure stage cross head that is coupled to the piston via a piston rod;

a low-pressure stage connecting rod has one end of which is coupled to the eccentric shaft part and the other end of which is coupled to the low-pressure stage cross head;

a high-pressure stage cross head that is coupled to the two plungers via respective plunger rods;

a high-pressure stage connecting rod has one end of which is coupled to the eccentric shaft part and the other end of which is coupled to the high-pressure stage cross head, is arranged in such a way as to move in a horizontal direction and has an opening formed through its top frame part in a vertical direction;

the high-pressure stage cross head is formed in a shape of one nearly rectangular frame, the eccentric shaft part, the low-pressure stage connecting rod, and the high-pressure stage connecting rod are arranged in the frame of the high-pressure stage cross head, the high-pressure stage cross head has an opening formed through its top frame part in a vertical direction, the low-pressure stage connecting rod is passed through the opening and is coupled to the eccentric shaft part and the low-pressure stage cross head, and the crank mechanism, the low-pressure stage compression part, and the two high-pressure stage compression parts are arranged in such a way that they are substantially located in a same plane.

2. The reciprocating compressor as claimed in claim 1, wherein one end of the high-pressure stage connecting rod is bifurcated and coupled to the eccentric shaft part, and wherein one end of the low-pressure stage connecting rod is arranged in a center space between bifurcated portions of the high-pressure stage connecting rod and is coupled to the eccentric shaft part.

* * * * *